US006686726B1

(12) United States Patent
Boylan

(10) Patent No.: US 6,686,726 B1
(45) Date of Patent: Feb. 3, 2004

(54) TRACKING OR INDEPENDENT OUTPUT VOLTAGE ADJUSTMENT FOR MULTIPLE OUTPUT SUPPLIES

(75) Inventor: Jeffrey Boylan, Richardson, TX (US)

(73) Assignee: Innoveta Technologies, Inc., Plano, TX (US)

( * ) Notice: Subject to any disclaimer, the term of this patent is extended or adjusted under 35 U.S.C. 154(b) by 0 days.

(21) Appl. No.: 10/215,135

(22) Filed: Aug. 8, 2002

(51) Int. Cl.[7] ..... G05F 1/40
(52) U.S. Cl. ..... 323/266
(58) Field of Search ..... 323/266, 268, 323/269, 270, 273, 275, 279, 281, 282, 285

(56) References Cited

U.S. PATENT DOCUMENTS 5,036,452 A * 7/1991 Loftus ..... 363/71
6,229,291 B1 * 5/2001 Matsumura et al. ..... 323/282

* cited by examiner

*Primary Examiner*—Matthew V. Nguyen
(74) *Attorney, Agent, or Firm*—David W. Carstens; Carstens Yee & Cahoon, LLP

(57) ABSTRACT

An apparatus, system, and method to offer either independent output adjustment or tracking output voltages in a post regulated converter is provided. A new resistor divider and reference structure is introduced, which offers simplicity and low parts count in achieving the two different output voltage adjustment functions. In one embodiment, the voltage regulator includes a plurality of output voltage pins, a plurality of independent trim pins, a tracking trim adjust pin, a plurality of voltage error pins, a reference voltage supply; and a plurality of operational amplifiers. The plurality of output voltage pins are coupled to a first input and an output of the operational amplifiers. The reference voltage supply is coupled a second input of each of the operational amplifiers. The tracking trim adjust pin is coupled to the first input of each of the operational amplifiers. The independent trim pins are coupled to the second input of the operational amplifiers and the voltage error pins are coupled to the output of the operational amplifiers.

32 Claims, 4 Drawing Sheets

TRACKING OR INDEPENDENT OUTPUT VOLTAGE ADJUSTMENT FOR MULTIPLE OUTPUT SUPPLIES

BACKGROUND OF THE INVENTION

1. Technical Field

The present invention is related generally to integrated circuits. More specifically, the present invention is directed toward voltage regulator circuits.

2. Description of Related Art

Integrated circuits continue their trend to higher transistor densities and smaller feature sizes. As the technology in different devices forces different supply requirements, various low voltage standards are propagating. While early "logic circuits" used 5V, today's devices require 5V, 3.3V, 2.8V, 2.5V, 2.0V, 1.8V, 1.5V, 1.2V, 0.9V and others. Each type of "logic circuit" requires a voltage supply that consistently supplies an appropriate stable voltage with little or no voltage fluctuations in order to prevent erroneous output from the "logic circuit". Various types of voltage regulators are provided in the prior art for this function.

One type of prior art single output voltage regulator is illustrated in FIG. 1. FIG. 1 depicts a schematic diagram illustrating a prior art technique in which a shunt regulator (U2) is combined with a voltage divider to provide regulation of a single output power supply. In this case, the output voltage Vout is divided down by resistors R1 and R2 and compared to the internal reference in the shunt regulator U2. The error voltage that results from this comparison is typically fed back through an optocoupler 104 (an optocoupler, also known as an optoisolater, is a coupling device in which a light emitting diode, energized by the input signal, is optically coupled to a photodetectors such as a light-sensitive output diode, transistor, or silicon controlled rectifier) to adjust the duty ratio of the switching converter, thereby regulating the output voltage Vout. For this structure, the output voltage Vout can be adjusted by modifying the current in the voltage divider 100 through resistor R3 (henceforth "divider trim"). If current is sunk from the output adjust terminal 102, the regulation voltage Vout is increased; if current is sourced into the adjust terminal 102, the output voltage Vout is decreased.

FIG. 2 depicts a schematic diagram illustrating the other prevalent prior art technique for single output regulation. Here, an independent two-terminal reference is used (instead of a shunt regulator as in FIG. 1) with an opamp U1A to build an error amplifier. While the divider trim can also be used here (by tying R3 to the junction of R1 and R2), the displayed circuit employs "reference trim" R3. Here, a current applied through reference trim R3 can increase or decrease the value of the reference being delivered to the amplifier U1A at the non-inverting input terminal 206. This change in reference voltage results in a change in output voltage Vout1. Notice that the polarity of the adjustment will be opposite that of the divider trim; a current sink from the adjust terminal 202 lowers the output voltage Vout1, and a current source into the adjust terminal 202 increases output voltage Vout1.

The reference trim has several advantages. It offers a consistent percentage change in output voltage Vout1 for a given adjust current, regardless of the output divider ratio. It also allows for very wide trim range without impacting the gain of the feedback control loop. The trim input can also be heavily filtered for noise immunity, without impacting the loop speed or stability.

Although the systems described above are useful for systems requiring one voltage rail, they are not as appropriate for the mixed low voltage systems requiring various voltages that have become commonplace. The packaging density and thermal demands have likewise continued to grow with each new generation of product. As a result, there is a need for power converters with high density, high efficiency, and multiple outputs, to energize these systems.

Multiple output switching power modules in standard footprints are frequently used in communications systems to fill the market needs. Multiple vendor sources for these supplies are often required, driving some common specifications. Many multiple output supplies rely on cross regulation, achieved through scaled winding ratios, to deliver multiple outputs with only one feedback regulation loop. Cross-regulated units suffer several drawbacks: poor load regulation, crosstalk, poor resolution in setting output voltages, complicated magnetic designs, and no flexibility for independent output adjustment.

For cross-regulated units, regulation is frequently achieved through a TL431 type shunt regulator which senses a weighted version of the multiple outputs. This regulator develops an error signal, which is used to modulate the duty cycle of the power switch. Output voltage adjustment is necessarily a tracking output adjustment, as the two cross-regulated outputs are always proportionally scaled. A 10% adjustment will adjust both outputs by 10%. As the inexpensive TL431 does not normally offer a pinned-out, adjustable reference, the only means for adjusting the set point is to modify the current in the weighted output voltage divider.

An example of a shunt regulator is provided in FIG. 3, which depicts a schematic diagram illustrating a prior art extension of the usage of the reference trim to a multiple output supply. Here, the feedback divider is the weighted average of two output voltages Vout1 and Vout2, generated by the summing node at the junctions of R1 and R2. For cross-regulated supplies, this technique is desirable since it can help compensate for poor load regulation when the two output loads are imbalanced. For this circuit, one can determine that the DC trim pin 302 current is a function of all the divider resistors (R1–R4), the reference value of the shunt regulator, R5, Vout1 and Vout2, and the impedance on the trim pin 302. Output voltage Vout1 and Vout2 adjustment through the single trim pin 302 is necessarily a tracking output adjustment, as the two cross-regulated outputs Vout1 and Vout2 are always proportionally scaled. For example, a 10% adjustment will adjust both outputs Vout1 and Vout2 by 10%.

Switching post regulators (or other methods of independent regulation) offer superior flexibility, regulation and set point selection. The outputs feature independent feedback loops, so the regulation of the outputs is not necessarily linked. To take advantage of this flexibility, post-regulated multiple outputs often offer two adjustable references and two output adjustment pins, so that the outputs may be adjusted independently. The outputs are compared to their references with separate regulation amplifiers, providing excellent regulation.

Consequently, the post regulator output adjustment circuits are often not compatible with those of cross-regulated units, making it difficult to drop them into applications using cross-regulated modules. The "divider trim" method results in a different trim impedance, and sinking current from the trim pin results in an increased output voltage. The "reference trim" method lowers the output when sinking current from the trim pin.

To offer a product with even broader application, a new approach is needed: a method to offer either tracking output adjustment or independent adjustment in a post-regulated circuit, while maintaining the regulation advantages of the post regulator.

SUMMARY OF THE INVENTION

The present invention provides a simple method to offer either independent output adjustment or tracking output voltages in a post regulated converter. A new resistor divider and reference structure is introduced, which offers simplicity and low parts count in achieving the two different output voltage adjustment functions. In one embodiment, the voltage regulator includes a plurality of output voltage pins, a plurality of independent trim pins, a tracking trim adjust pin, a plurality of voltage error pins, a reference voltage supply; and a plurality of operational amplifiers. The plurality of output voltage pins are coupled to a first input and an output of the operational amplifiers. The reference voltage supply is coupled a second input of each of the operational amplifiers. The tracking trim adjust pin is coupled to the first input of each of the operational amplifiers. The independent trim pins are coupled to the second input of the operational amplifiers and the voltage error pins are coupled to the output of the operational amplifiers.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 3:
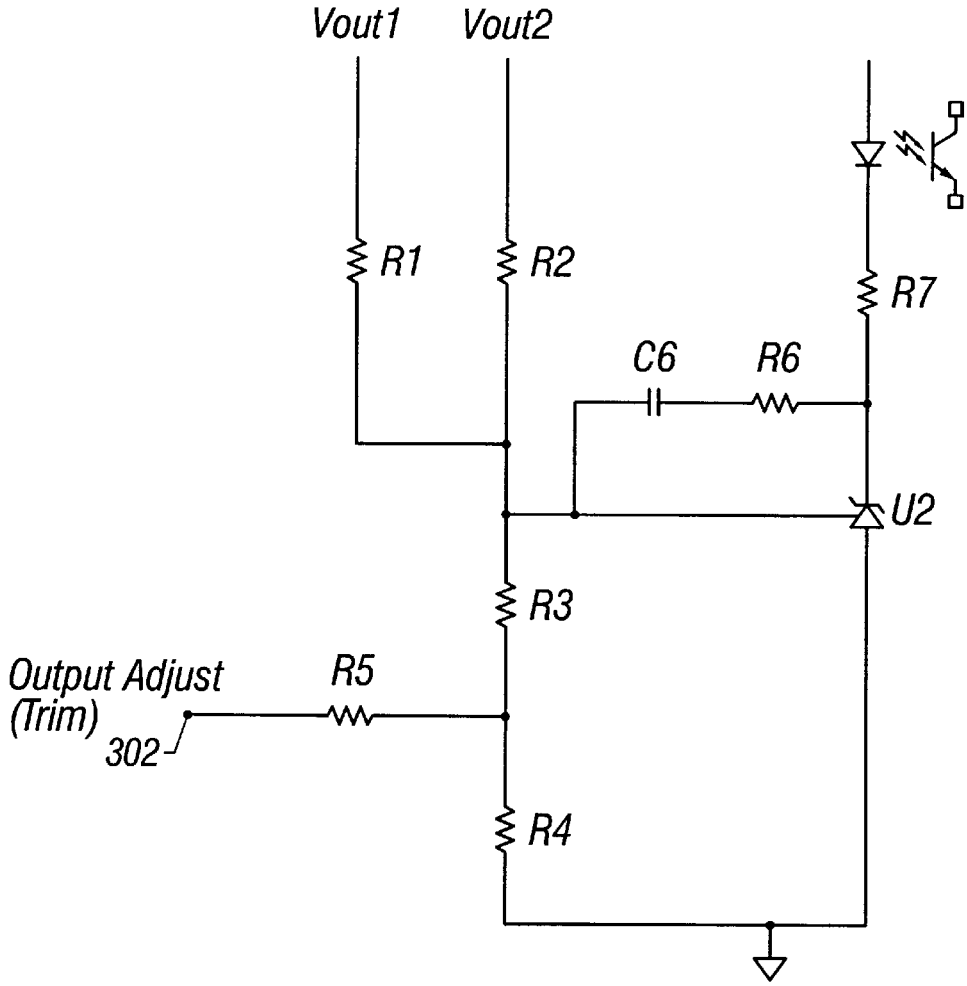
FIG. 3 (Prior Art)
FIG. 3 depicts a schematic diagram illustrating the extension of the usage of the reference trim to a multiple output supply in accordance with the prior art.

One goal of this invention is to provide compatible trim operation with cross-regulated multiple output regulators as shown in FIG. 3, while offering better regulation of both outputs through the use of multiple feedback loops. In addition, the invention allows for independent adjustment of either output Vout1 or Vout2 using the reference trim method.

Figure 4:
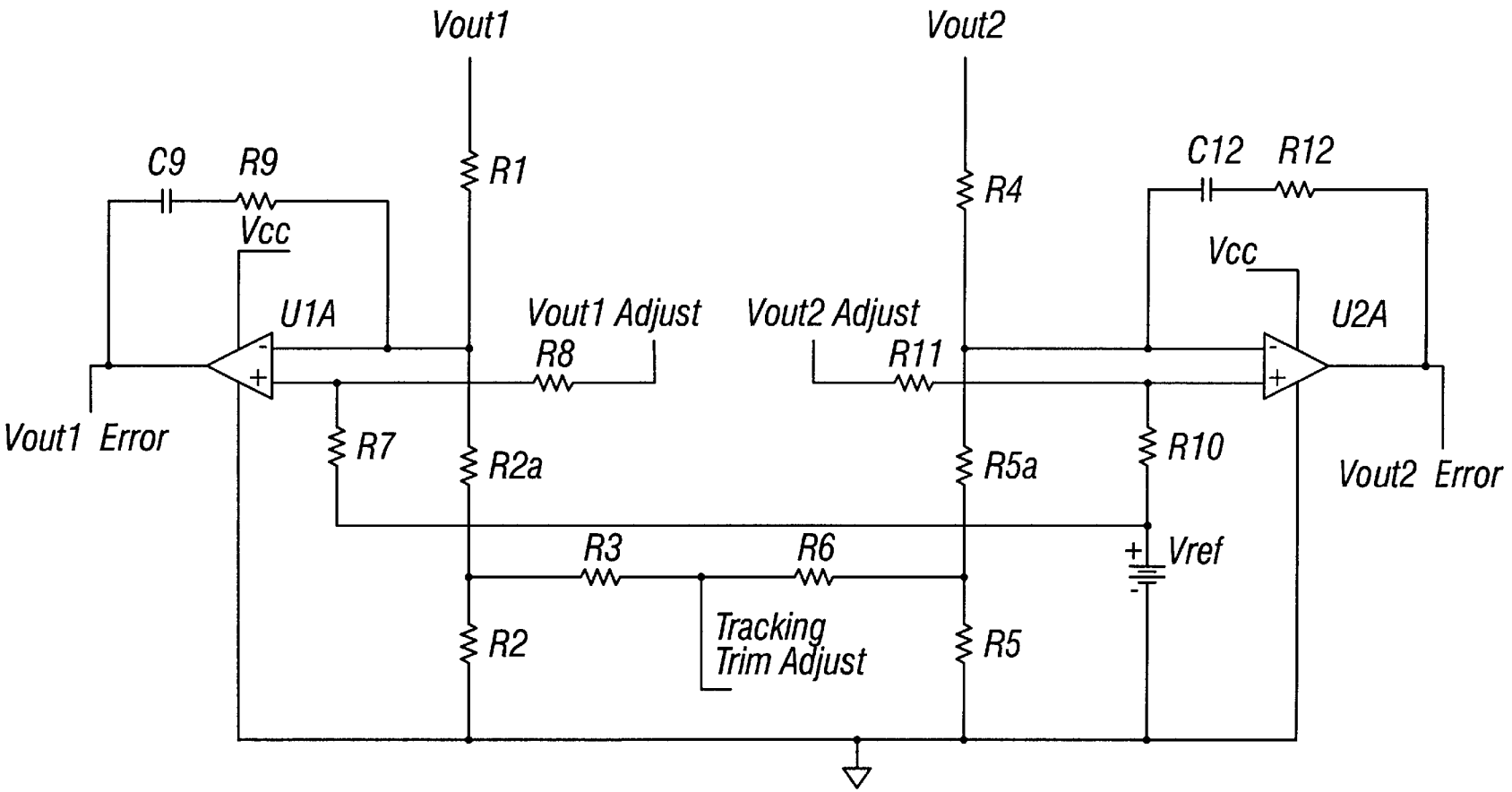
FIG. 4 depicts a schematic diagram illustrating a dual output regulator with options for tracking output adjustment and independent output adjustment in accordance with one embodiment of the present invention.

With reference now to FIG. 4, a schematic diagram illustrating a dual output regulator with options for tracking output and independent output adjustment is depicted in accordance with one embodiment of the present invention. The circuit as shown may be configured in two ways: single tracking trim operation or dual trim operation. In single tracking trim operation, resistors R8 and R11 are depopulated, disconnecting independent trim pins Vout1 Adjust and Vout2 Adjust. In dual independent trim operation, resistors R3 and R6 are depopulated, disconnecting the tracking trim function Tracking trim adjust.

To reuse one of the trim pins for either one feature or another, a jumper may be provided (for example, from Vout1 adjust to Tracking Trim adjust). Of course, if all functions are offered simultaneously, all components may be populated.

In a simplified form, one or more of the following resistors can be shorted out (removed) from the circuit: R2*a*, R5*a*, R3, R6, R8, R11. However, these resistors provide additional flexibility, which is often desired to achieve the appropriate trim function, and to offer trim range limiting and noise immunity.

Additional stages may be added to extend the application from two to three or more outputs.

Figure 5:
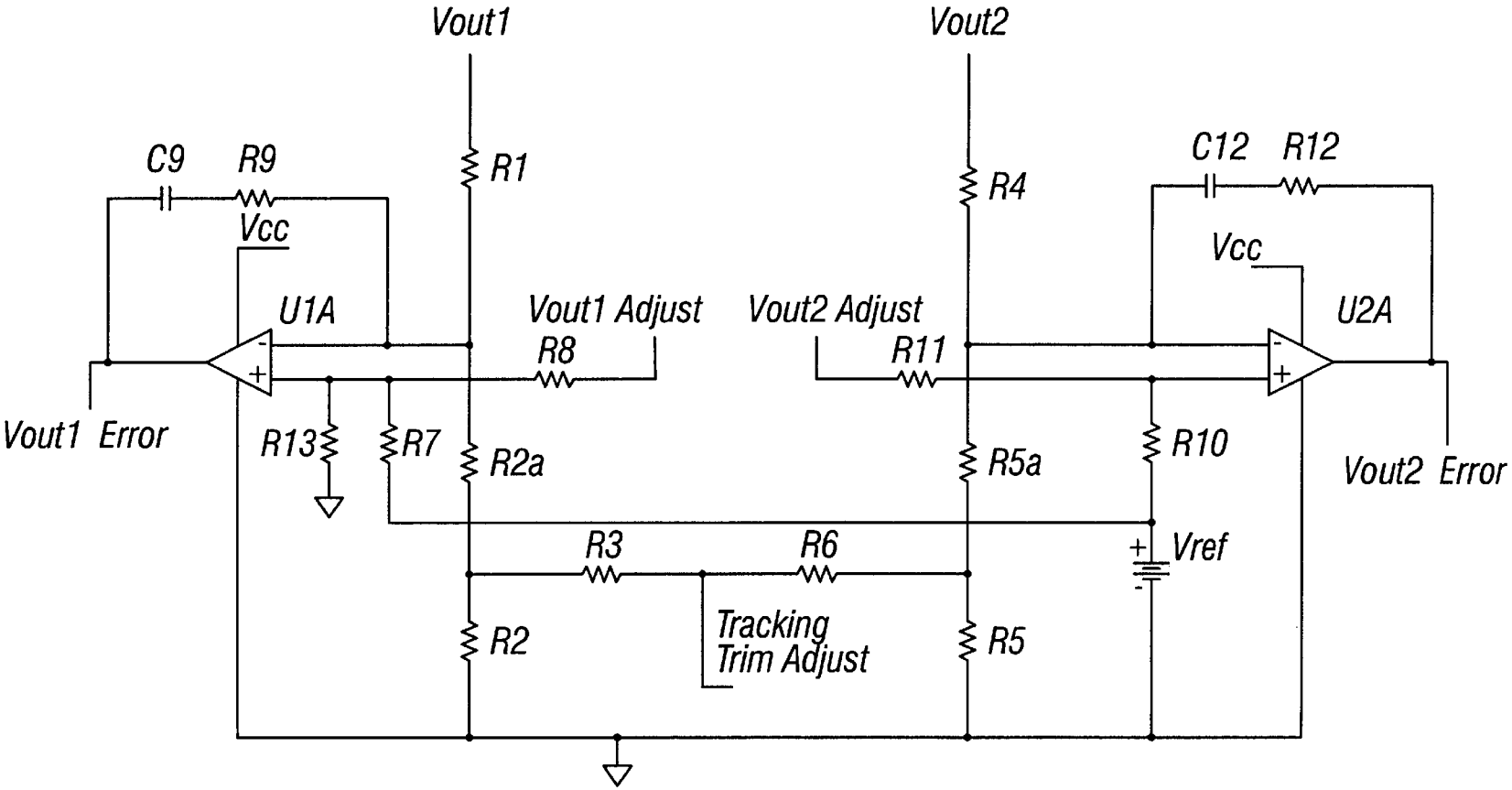
FIG. 5 depicts a schematic diagram illustrating a dual output regulator with options for tracking output adjustment and independent output adjustment as well as a voltage divider to provide different reference voltages for each operational amplifier in accordance with one embodiment of the present invention.

Single tracking trim option:

The single tracking trim option is provided by resistors R1, R2, R2*a*, R3, R4, R5, R5*a*, and R6. Separate amplifiers, U1A and U2A, are provided to allow each output voltage Vout1 and Vout2 to be compared to a reference, generating independent error voltages Vout1 Error and Vout2 Error for feedback control. This independent feedback control gives excellent regulation of both outputs Vout1 and Vout2. In the depicted example, one reference voltage Vref regulates both outputs Vout1 and Vout2, but in other embodiments, two reference voltages may be utilized. Such an embodiment may be obtained by modifying the circuit diagram in FIG. 4 such that resistor R7 is coupled to a second reference voltage and is decoupled from the first reference voltage Vref. In other embodiments, rather than having two reference voltages, a voltage divider may be introduced into the non-inverting terminal of one of the amplifiers U1A and U2A. An example of this embodiment is depicted in FIG. 5. The dual output regulator depicted in FIG. 5 is identical to that in FIG. 4 except that the reference voltage coupled to the non-inverting input of amplifier U1A has been divided down by the introduction of resistor R13. Thus, the reference voltages supplied for each output voltage may be adjusted to different values.

To design the proper resistor values, some network analysis is required. The most straightforward technique is to generate the equations for the node voltages and branch currents in the resistor network. Using these, one can solve for the programmed output voltages as a function of the reference value, the trim pin Tracking trim adjust impedance and connection point, and all of the resistor values R1–R12.

If the desired trim function is known, nine equations in nine unknowns may be written and solved through matrix or numerical techniques, to determine the values of the eight resistors and the reference. However, if fewer than nine equations are provided, then multiple solutions would satisfy the design goals. For example, a typical design goal might specify that a +10% adjustment in the output voltage corresponds to grounding the trim pin, a −10% adjustment in the output voltage corresponds to tying the trim pin to the output voltage, and provide nominal set points. Thus, such a design goal results in only six equations. Therefore, with such a design goal, multiple solutions could be determined, each of which would satisfy the design goals.

Figure 1:
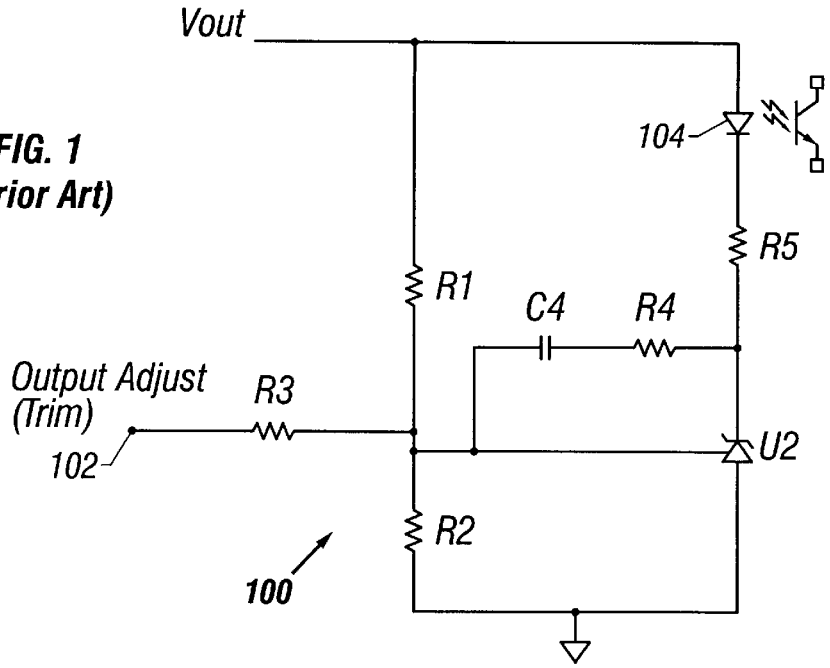
FIG. 1 (Prior Art)
FIG. 1 depicts a schematic diagram illustrating a prior art technique in which a shunt regulator (U2) is combined with a voltage divider to provide regulation of a single output power supply.
Figure 2:
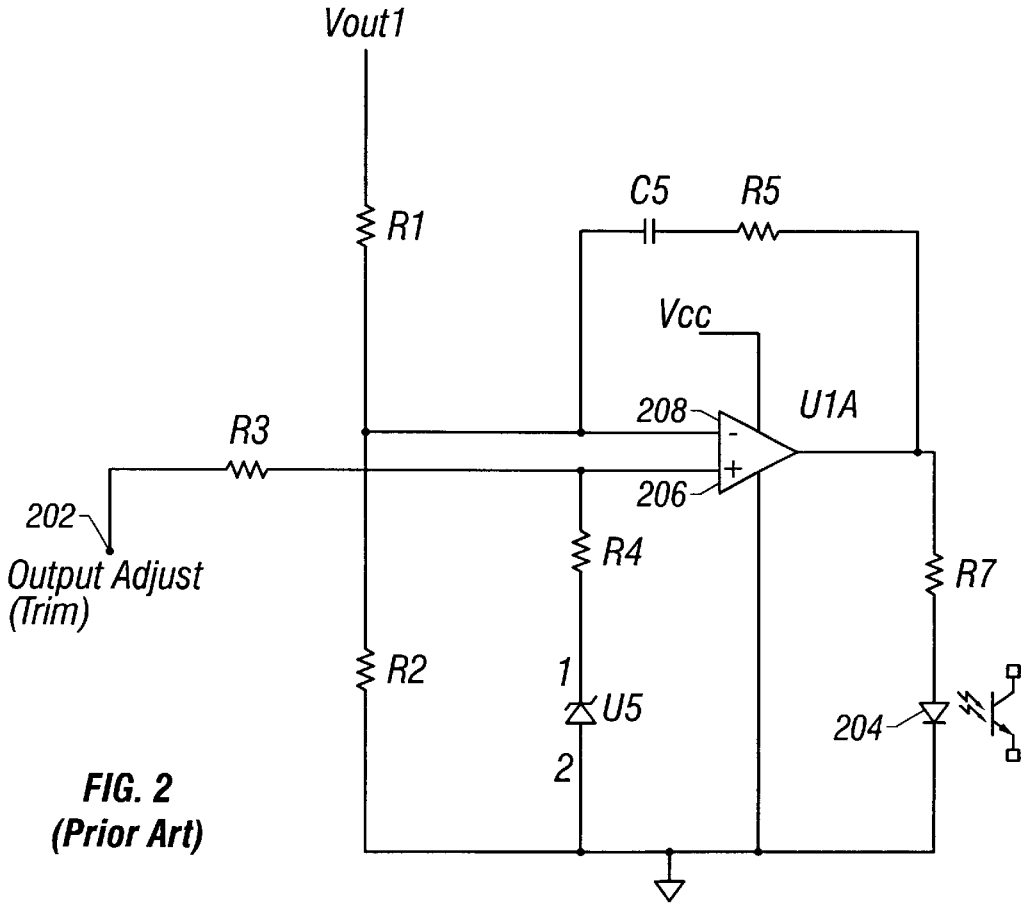
FIG. 2 (Prior Art)
FIG. 2 depicts a schematic diagram illustrating the other prevalent prior art technique for single output regulation.

Independent Voltage Adjust Option:

In the case of a tracking trim pin, with resistors R3 and R6 depopulated, the output dividers are decoupled and the network can be reduced to be exactly two instances of the reference trim circuit 200 in FIG. 2, using a common voltage reference. The independent trim pins can be designed to allow a wide range independent adjustment of either output voltage Vout1 and Vout2.

In either independent voltage adjust option or tracking trim pin option, the two outputs, Vout1 and Vout2 are substantially decoupled from each other with a coupling on the order of 30% or less. Thus, if the circuit is designed and utilized in tracking trim adjust mode, both Vout1 and Vout2 may have errors Vout1 error and Vout2error adjusted simultaneously and independently, such that a very accurate and stable voltage is obtained for both outputs. However, prior art dual voltage regulators utilizing tracking trim adjust methods, such as that depicted in FIG. 3, are capable of only adjusting the error on one or the other of the outputs. Furthermore, prior art dual voltage regulators utilizing tracking trim adjust methods may only provide output voltages in which the larger output voltage is an integer multiple of the other output voltage, whereas the voltage regulator of the present invention may provide output voltages that are either integer or non-integer multiples of each other.

To understand how the control loops are substantially decoupled, consider that if the error amplifiers, U1A and U2A both operate in a linear mode, the inputs will be held to be significantly equal. Therefore, the reference voltage which is applied to the non-inverting terminal will cause a "virtual reference" to appear at the inverting terminal, even as the amplifier responds to correct a transient change in output voltage. As a result, the current in the lower half of the resistor dividers (R2*a*, R2, R5*a*, R5) and the current between the divider ladders (in R3 and R6) remain constant during such transients. The change in current during a transient is isolated to the upper half of the divider, and the feedback current around the affected amplifier. As a result, there is negligible "crosstalk" between the output regulation channels in this regulation and adjustment network.

Even if the tracking trim pin is tied resistively to one of the outputs (to trim down, for instance), the gain of the trim pin is typically low, so coupling between the perturbed output and the steady state output is small.

In another embodiment, the independent trim pins Vout1 adjust and Vout2 adjust are tied together to form a tracking trim pin. This embodiment works particularly well for the case where one reference is used (as in FIG. 4), and the value of resistors R7 and R10 are equal and the values of the resistors R8 and R11 are equal. This arrangement could be accommodated with fewer parts by omitting resistors R10 and R11 and directly (or through a jumper) connecting the non-inverting inputs of the amplifiers together in which case, Vout1 adjust becomes a tracking trim pin. Generally, this solution will not satisfy the need for trim equation compatibility with "divider trim" circuits, but does allow for either tracking or independent function.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

I claim:

1. A voltage regulation circuit for multiple voltage outputs, comprising:

at least one reference voltage supply;

a first and a second voltage control loop substantially decoupled from each other and each of which is resistively coupled to a reference voltage supply;

a first voltage output resistively coupled to the first voltage control loop;

a second voltage output resistively coupled to the second voltage control loop; and a tracking trim adjust input resistively coupled to the first voltage output by a first resistive element and resistively coupled to the second voltage output by a second resistive element; wherein the error on the first and the second voltage outputs are independently controlled.

2. The voltage regulation circuit as recited in claim 1, wherein the ratio of voltages between the first and second voltage outputs is a non-integer value.

3. The voltage regulation circuit as recited in claim 1, wherein the coupling between the first and second voltage control loops is less than approximately 30%.

4. The voltage regulation circuit as recited in claim 1, wherein the first voltage control loop comprises:

an error amplifier having a first input, a second input, and an output; wherein the first input is resistively coupled to the first voltage output;

the first input is resistively coupled to the tracking trim adjust input;

the second input is resistively coupled to a reference voltage; and the output is capacitively and resistively coupled to the first input.

5. The voltage regulation circuit as recited in claim 4, wherein the first input is an inverting input.

6. The voltage regulation circuit as recited in claim 4, wherein the second input is a non-inverting input.

7. The voltage regulation circuit as recited in claim 4, wherein the error amplifier is a first error amplifier and the second voltage control loop comprises:

a second error amplifier having a third input, a fourth input, and a second output; wherein the third input is resistively coupled to the second voltage output;

the third input is resistively coupled to the tracking trim adjust input;

the fourth input is resistively coupled to a reference voltage; and the second output is capacitively and resistively coupled to the third input.

8. The voltage regulation circuit as recited in claim 7, wherein the third input is an inverting input.

9. The voltage regulation circuit as recited in claim 7, wherein the fourth input is a non-inverting input.

10. A voltage regulation circuit for multiple voltage outputs, comprising:

a first and a second voltage control loop, each of which is substantially decoupled from the other and each of which is resistively coupled to the reference voltage supply;

a first voltage output resistively coupled to a first input of the first voltage control loop;

a second voltage output resistively coupled to a first input of the second voltage control loop;

a reference voltage supply resistively coupled to a second input of each of the first and second voltage control loops;

a tracking trim voltage adjust input restively coupled to the second input of the first voltage control loop and resistively coupled to the second input of the second voltage control loop; wherein the error on the first and the second voltage outputs are independently adjustable.

11. The voltage regulation circuit as recited in claim 10, wherein the coupling between the first and second voltage control loops is less than approximately 30%.

12. The voltage regulation circuit as recited in claim 10, wherein the first voltage control loop comprises:

an error amplifier having a first input, a second input, and an output; wherein the first input is resistively coupled to the first voltage output;

the second input is resistively coupled to the first voltage adjust input; and the output is capacitively and resistively coupled to the first input.

13. The voltage regulation circuit as recited in claim 12, wherein the first input is an inverting input.

14. The voltage regulation circuit as recited in claim 12, wherein the second input is a non-inverting input.

15. The voltage regulation circuit as recited in claim 12, wherein the error amplifier is a first error amplifier and the second voltage control loop comprises:

a second error amplifier having a third input, a fourth input, and a second output; wherein the third input is resistively coupled to the second voltage output;

the fourth input is resistively coupled to the second voltage adjust input; and the second output is capacitively and resistively coupled to the third input.

16. The voltage regulation circuit as recited in claim 15, wherein the third input is an inverting input.

17. The voltage regulation circuit as recited in claim 15, wherein the fourth input is a non-inverting input.

18. A method for constructing a voltage regulation device for multiple voltage outputs, comprising:

(a) fabricating a multiple voltage output regulation circuit having components compatible with both tracking trim adjust voltage regulation and independent voltage regulation;

(b) responsive to a determination that a tracking trim adjust device is desired, resistively coupling a tracking trim adjust pin to the multiple voltage output regulation circuit; and (c) responsive to a determination that an independent voltage regulation device is desired, coupling respective ones of multiple independent voltage adjust input pins to respective segments of the multiple voltage output regulation circuit.

19. The method as recited in claim 18, further comprising:

responsive to a determination that both tracking trim adjustment and independent voltage adjustment functions are desired to be supported, performing both steps (b) and (c).

20. The method as recited in claim 18, wherein the voltage regulation device is a dual voltage output device.

21. The method as recited in claim 20, wherein the pin configuration for the independent voltage regulation device comprises only one more pin than the pin configuration for the tracking trim adjustment device.

22. A voltage regulation device fabricated according to the method as recited in claim 18.

23. A system for constructing a voltage regulation device for multiple voltage outputs, comprising:

(a) means for fabricating a multiple voltage output regulation circuit having components compatible with both tracking trim adjust voltage regulation and independent voltage regulation;

(b) means, responsive to a determination that a tracking trim adjust device is desired, for resistively coupling a tracking trim adjust pin to the multiple voltage output regulation circuit; and (c) means, responsive to a determination that an independent voltage regulation device is desired, for coupling respective ones of multiple independent voltage adjust input pins to respective segments of the multiple voltage output regulation circuit.

24. The system as recited in claim 23, further comprising:

means, responsive to a determination that both tracking trim adjustment and independent voltage adjustment functions are desired to be supported, for resistively coupling a tracking trim adjust input pin and multiple independent voltage adjustment input pins to respective segments of the multiple voltage output regulation circuit.

25. The system as recited in claim 23, wherein the voltage regulation device is a dual voltage output device.

26. The system as recited in claim 24, wherein the pin configuration for the independent voltage regulation device comprises only one more pin than the pin configuration for the tracking trim adjustment device.

27. A regulation circuit for multiple output power supplies, comprising:

a plurality of voltage outputs;

a plurality of independent voltage adjust inputs;

a tracking trim adjust input;

at least one reference voltage supply; and a plurality of operational amplifiers; wherein the plurality of voltage outputs are coupled to a first input and an output of the operational amplifiers;

the reference voltage supply is coupled a second input of each of the operational amplifiers;

the tracking trim adjust pin is resistively coupled to the first input of a first of the plurality of operational amplifiers and is resistively coupled to the first input of a second of the plurality of operational amplifiers;

a first of the independent voltage adjust inputs is coupled to the second input of the first of the plurality of operational amplifiers; and a second of the independent voltage adjust inputs is coupled to the second input of the second of the plurality of operational amplifiers.

28. The regulation circuit as recited in claim 27, wherein at least one of the voltage outputs is coupled to the first input of one of the operational amplifiers via a resistor.

29. The regulation circuit as recited in claim 27, wherein at least one of the voltage outputs is coupled to the output of one of the operational amplifiers via a resistor and a capacitor.

30. The regulation circuit as recited in claim 27, wherein at least one reference voltage supply is resistively coupled to the second input of at least one of the operational amplifiers.

31. The regulation circuit as recited in claim 27, wherein the tracking trim adjust input is coupled to the first input of each of the operational amplifiers by a respective resistor.

32. The regulation circuit as recited in claim 27, wherein the independent trim pins are coupled to the second input of corresponding operational amplifiers by a respective resistor.

* * * * *